United States Patent [19]

Okamoto et al.

[11] 4,247,195

[45] Jan. 27, 1981

[54] BIAS DEVICE FOR A COPYING MACHINE

[75] Inventors: Toyoo Okamoto, Yokohama; Masashi Kuno, Tokyo, both of Japan

[73] Assignee: Ricoh Co., Ltd., Tokyo, Japan

[21] Appl. No.: 50,227

[22] Filed: Jun. 20, 1979

[30] Foreign Application Priority Data

Jun. 21, 1978 [JP] Japan ..... 53-75221

[51] Int. Cl.[3] ..... G03G 15/00

[52] U.S. Cl. ..... 355/14 D; 118/647; 355/10

[58] Field of Search ..... 355/14 D, 10, 3 DD; 118/647, 648

[56] References Cited

U.S. PATENT DOCUMENTS

| | | | |
|---|---|---|---|
| 3,782,818 | 1/1974 | Smith | 355/10 |
| 3,892,481 | 7/1975 | Schaefer et al. | 355/14 D |
| 4,006,709 | 2/1977 | Miyakawa et al. | 118/648 |
| 4,035,071 | 7/1977 | Miyakawa et al. | 355/10 |
| 4,050,806 | 9/1977 | Miyakawa et al. | 355/14 D |
| 4,052,127 | 10/1977 | Kuroishi et al. | 355/3 DD |
| 4,087,171 | 5/1978 | Yano | 355/14 D |
| 4,168,329 | 9/1979 | Miyakawa et al. | 355/10 X |
| 4,176,942 | 12/1979 | Tatsumi et al. | 355/10 X |

*Primary Examiner*—R. L. Moses

*Attorney, Agent, or Firm*—Oblon, Fisher, Spivak, McClelland & Maier

[57] ABSTRACT

In a bias device for a copying machine, the surface potential of the photo-sensitive member is detected and stored, a bias voltage is obtained by superposing a certain potential on the potential thus stored, the surface potential of an electrode confronting the photo-sensitive member is stored in a non-image period occurring with the photo-sensitive member, and the bias voltage is applied to the electrode in an image development period occurring with the photo-sensitive member, whereby troubles due to the residual voltage of the photo-sensitive member are effectively overcome.

7 Claims, 6 Drawing Figures

BIAS DEVICE FOR A COPYING MACHINE

BACKGROUND OF THE INVENTION

This invention relates to a bias device for a copying machine, which operates to apply a bias voltage to an electrode which confronts the photo-sensitive member.

FIG. 1 is an explanatory diagram showing the arrangement of a copying machine to which the technical concept of this invention is applied. Provided around a photosensitive member 1 rotating in the direction of the arrow A are a discharging charger 2, a charging charger 3, an electrode 5 for applying a voltage produced by a bias device 4, and a transferring charger 6. A transferring sheet B is moved between the photo-sensitive member 1 and the transferring charger 6.

In FIG. 1, reference numeral 7 designates an original placed on a contact glass plate 8, and reference numeral 9 designates an exposure lamp. Light reflected by the original 7 is applied through a first mirror 10, a second mirror 11, an in-mirror lens 12, a fourth mirror 13 and a slit 14 to the photo-sensitive member 1.

One cycle of copying operation consists of the step of charging by the charging charger 3, the step of exposure by light applied through the slit 14, the step of development, the step of transferring by the transferring charger 6, and the step of fixing.

The effect that a bias voltage is applied to the electrode 5 by the bias device 4, will be described.

The charges left in the photo-sensitive member 1 in the preceding copying operation are removed by the discharging charger 2, and thereafter new charges are created in the photo-sensitive member 1 by means of the charging charger 3. Among these charges, the charges corresponding to the character region are left as they are but the charges corresponding to the white background region are removed during the exposure operation in the exposure section. Thus, the character region has a high potential, while the white background region has a low potential, thus forming a latent image on the photo-sensitive member 1.

In the next process, i.e., in the step of development, a toner is applied to the latent image. The toner is stuck to the character region, as a result of which the latent image is developed. However, in this operation, the toner is stuck to the white background region to an extent; that is, a portion which should not be developed is also developed.

In order to eliminate this difficulty, during the development a voltage having the same polarity as that of the latent image is applied, as a bias voltage, to the electrode 5, to attract the toner stuck to the white background region, thereby to prevent the adhesion of the toner to the white background region. In this case, the amount of toner stuck to the character region is somewhat reduced, and therefore it is necessary to minimize this effect by suitably selecting the bias voltage.

The developed image thus obtained is transferred onto a transferring sheet in the transferring section provided with the transferring charger 6, and is then converted into a copy image in the step of fixing.

As is apparent from the above description, the bias voltage applied to the electrode 5 should have a suitable value in correspondence to the character and white background regions of an original in any copying process. In general, a voltage charged in the photo-sensitive member 1 by the charging charger 3 is of the order of 1,000 volts, and the voltages of the portions, corresponding to the character and white background regions, of the member 1 exposed are of the order of several hundreds of volts and several tens of volts, respectively. Accordingly, it is suitable that the bias voltage is one hundred and several tens of volts (slightly higher than the potential of the white background region) to several hundreds of volts (slightly lower than the potential of the character region).

However, there is still a problem. That is, in the case where the developed image is transferred onto a number of sheets, the residual potential of the photo-sensitive member 1 after the transferring cannot be completely eliminated even with the discharging charger 2, and the residual potential V is increased with the number of times (n) of repetition as indicated in FIG. 2. (In FIG. 2, reference character $V_0$ designates a residual potential due to the fatigue of the photo-sensitive member. After the copying operation, the residual potential is restored to the value $V_0$.). Sometimes, the residual potential reaches several hundreds of volts. In this case, it is necessary to apply a voltage higher than the residual potential as the bias voltage to obtain a satisfactory copy image, because otherwise the portion having the residual potential of the previous copying operation would be developed. Accordingly, the bias voltage applied should be higher than the residual potential.

From the standpoint of the above description, the conventional bias device is unsatisfactory. The conventional bias devices are semi-automatic bias devices or automatic bias devices, none of which are satisfactory due to the following reasons: In the semi-automatic bias device, a resistor 19, a diode 20, a lower limit voltage $V_1$ setting Zener diode 17 and an upper limit voltage $V_2$ setting Zener diode 18 are connected to an electric source 16, as shown in FIG. 3, so that when the voltage induced by the photo-sensitive member is lower than the lower limit voltage $V_1$, the lower limit voltage $V_1$ is applied to the electrode 5, and when the voltage induced by the photo-sensitive member is higher than the lower limit voltage $V_1$ and lower than the upper limit voltage $V_2$, the potential of the electrode 5 is used as it is, and when the voltage induced is higher than the upper limit voltage $V_2$, the upper limit voltage $V_2$ is used as the bias voltage.

When the induced voltage is between the lower limit voltage $V_1$ and the upper limit voltage $V_2$, the induced voltage itself is used as the bias voltage, and therefore it is not the suitable voltage which is slightly higher than the potential of the white background region and the effect of keeping the background clear is low. This difficulty may be overcome by increasing the lower limit voltage $V_1$. However, in this case, even in the case when the induced voltage is low, the bias voltage is high, and the character region other than the white background region is excessively biased, as a result of which the density is decreased.

On the other hand, in the automatic bias device, as shown in FIG. 4, a sensor electrode 21 is provided before an electrode 5 to which a bias voltage is applied, so that the potential of the photo-sensitive member corresponding to several tens of millimeters from the end of an original (the range in which usually only "a white image" is available, but no character image is available) is detected by the sensor electrode 21, and a voltage on which a voltage Va at the detected potential is superposed by an amplifier 22 is applied through a contact means 23 to the electrode 5. In FIG. 4, a circuit consisting of a transformer 24, diodes 25 and 26, and capacitors 27 and 28 is to apply a negative bias voltage through the contact means 23 to the electrode 5 to clean the latter 5.

In the automatic bias device shown in FIG. 4, the potential of the predetermined range from the end of the original is detected, and the bias voltage is determined from the potential thus detected. Therefore, no matter what ratio of the character region to the white background region may be in the rear end of the original, the bias voltage defined by the potential of the front end of the original is applied to the electrod 5, and the voltage superposed cannot be changed in that copying cycle. Therefore, this voltage is not always a bias voltage suitable for the rear half of the original. Thus, in the rear half of the original, the white background region may be developed, or the density of the character region may be decreased as the case may be.

As is apparent from the above description, any conventional bias device suffers from a disadvantage that contrast between the white background region and the character region is unstable.

SUMMARY OF THE INVENTION

Accordingly, an object of this invention is to provide a bias device for a copying machine, in which all of the above-described drawbacks accompanying a conventional bias device have been eliminated.

More specifically, an object of the invention is to provide a bias device for a copying machine, in which the potential of a photo-sensitive member corresponding to an original is detected at all times to suitably change the bias voltage, thereby to make the contrast between the white background region and the character region stable.

The foregoing object and other objects as well as the characteristic features of the present invention will become more apparent from the following detailed description and the appended claims when read in conjunction with the accompanying drawings.

DETAILED DESCRIPTION OF THE INVENTION

Figure 1:
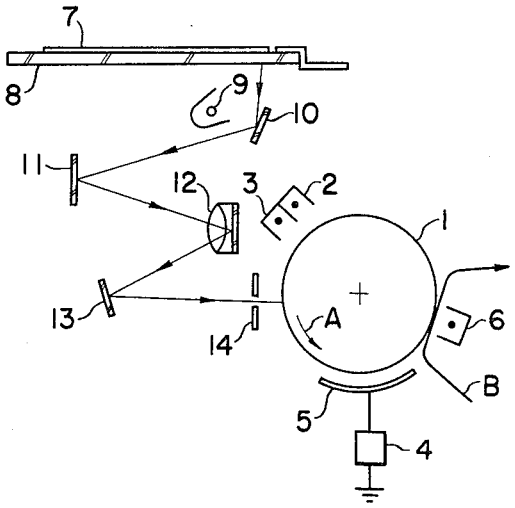
FIG. 1 is an explanatory diagram showing the arrangement of a copying machine for which a bias device according to the invention is provided.
Figure 2:
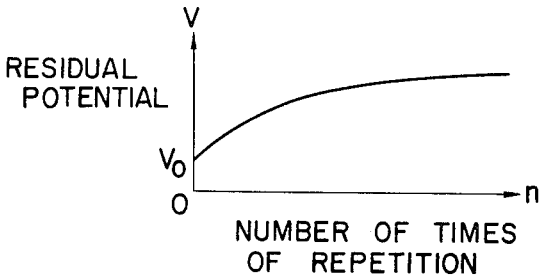
FIG. 2 is a graphical representation indicating the variations in residual voltage of a photo-sensitive member which are caused as a copying operation is repeated.
Figure 3:
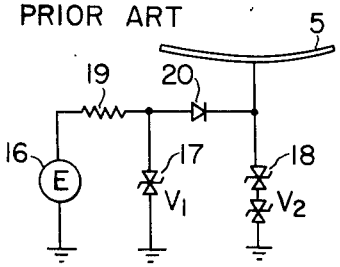
FIG. 3 PRIOR ART
FIG. 3 is a circuit diagram for a description of a conventional semi-automatic bias device.
Figure 4:
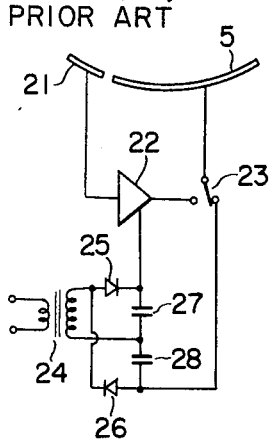
FIG. 4 PRIOR ART
FIG. 4 is a circuit diagram for a description of a conventional automatic bias device.
Figure 5:
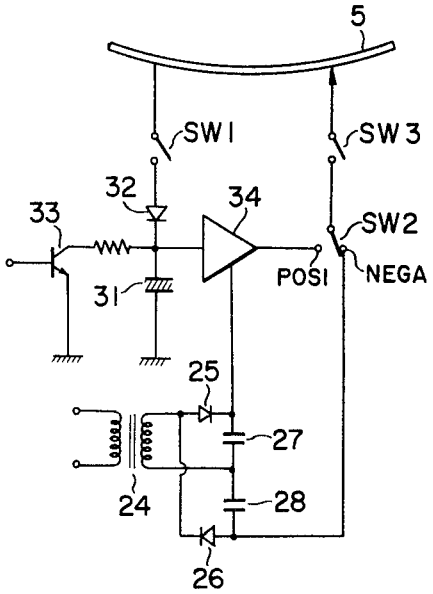
FIG. 5 is a circuit diagram showing one example of the bias device according to the invention; and The parts (A) through (E) of FIG. 6 are time charts for a description of the operation of the bias device according to the invention.

A preferred example of a bias device according to the invention, as shown in FIG. 5, comprises: an on-off switch SW1 for detecting an induced potential, corresponding to a photo-sensitive member, of an electrode 5; a capacitor 31 for storing the potential of the electrode 5; a reverse-current blocking diode 32; a capacitor discharging transistor 33; an amplifier 34 for superimposing a voltage on a detection voltage; a change-over switch SW2 for switching a positive bias voltage and a cleaning negative bias voltage; an on-off switch SW3 for applying a bias voltage to the electrode 5; a transformer 24; diodes 25 and 26; and capacitors 27 and 28. The transformer 24, diodes 25 and 26 and capacitors 27 and 28 form a negative bias voltage generating circuit, similarly as in FIG. 4.

For the electrode 5, there are provided a cleaning negative bias period, and an image bias period. In addition, it is necessary to provide a detection period in order to detect the potential of the photo-sensitive member from one and the same electrode. The detection period is obtained by switching the above-described switches SW1 through SW3.

Figure 6:
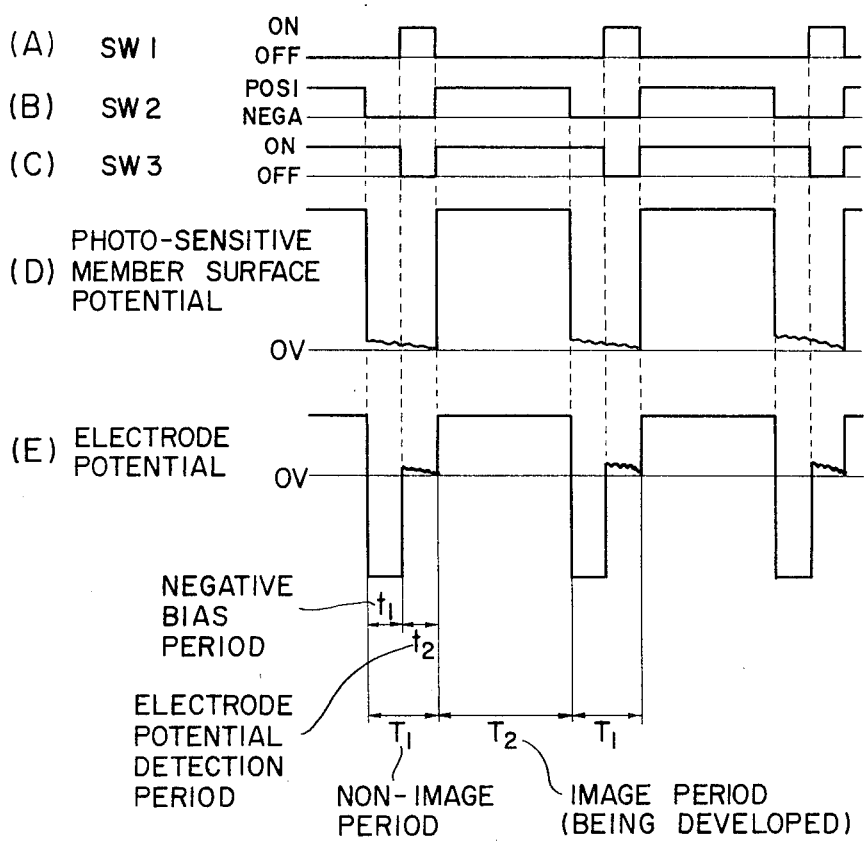

The operation of the circuitry shown in FIG. 5 will be described with reference to the parts (A) through (E) of FIG. 6, in which reference character $T_1$ designates a non-image period, $T_2$, an image period (being developed), $t_1$, the negative bias period, and $t_2$, an electrode potential detection period.

For the period of development ($T_2$), the electrode potential detecting switch SW1 is in off state, the switch SW3 is in on state, and the armature of the change-over switch SW2 is tripped to the positive bias contact, so that the output, or the positive bias voltage, of the amplifier 34 is applied through the switch SW3 to the electrode. After the development, i.e., when a non-image portion occurs on the surface of the photo-sensitive member (when the period $T_1$ starts), the armature of the switch SW2 is tripped over to the negative bias contact, and the voltage developed across the capacitors 27 and 28 is applied through the switches SW2 and SW3 to the electrode 5 to clean the latter 5. After the cleaning, the switch SW1 is turned on, and the switch SW3 is turned off, as a result of which the electrode 5 is placed in a floating state that no voltage is applied to the electrode 5. In this operation, the surface potential of the photo-sensitive member is induced and it is detected by turning on the switch SW1. The potential thus detected is applied through the diode 32 to the capacitor 31 where it is stored. A voltage obtained by superimposing a certain potential on the potential thus stored is amplified by the amplifier 34, whereby the next positive bias voltage is determined. Thus, when the next image portion occurs (the period $T_2$), the switch SW1 is turned off, the switch SW3 is turned on and the armature of the change-over switch SW2 is tripped to the positive bias contact, then the voltage thus determined is applied to the electrode 5. The above-described operation is repeatedly carried out.

When the copying operation is completed, the transistor 33 is rendered conductive by a copy completion signal to remove the charges stored in the capacitor 31.

In the above-described device, no electrode potential is stored in the capacitor 31 for the copying of the first sheet, and therefore a suitable bias voltage must be applied. However, no problem occurs in practice because the residual voltage of the surface of the photo-sensitive member is not so high for the copying of the first sheet.

As is apparent from the above description, the bias device according to the invention comprises a memory circuit for storing the potential of the surface of the photo-sensitive member, the circuit for providing the voltage obtained by superposing the certain potential on the potential stored in the memory circuit, the switch for storing the potential on the non-image interval of the photo-sensitive member in the memory circuit, and the switch for applying the voltage obtained by superposition to the bias voltage applying electrode. Therefore, even if the residual voltage of the photo-sensitive member is increased, the voltage is stored in the memory circuit, and therefore the suitable bias voltage can be obtained.

What is claimed is:

1. A bias device for a copying machine having a developing electrode confronting a photo-sensitive member, to which electrode a voltage is applied during development, which bias device comprises:

memory means for storing the potential of the surface of said photo-sensitive member;

voltage generating means for providing a voltage obtained by superposing a predetermined potential on said potential stored in said memory means;

means for allowing the potential of the surface of said photo-sensitive member to be stored in said memory means in a non-image period which occurs with said photo-sensitive member; and switch circuit means for applying said voltage provided by said voltage generating means to said electrode in an image period.

2. A bias device as claimed in claim 1, in which in said non-image period, when said switch means is in off state, a negative bias period is provided for said electrode, and when said switch means is in on state, a positive bias period is provided for said electrode.

3. A bias device as claimed in claim 1, in which upon completion of a copying operation, the contents of said memory means are cleared.

4. A bias device as claimed in claim 1, in which said memory means is a capacitor.

5. A bias device as claimed in claim 2, in which said memory means is a capacitor.

6. A bias device as claimed in claim 3, in which said memory means is a capacitor.

7. In a copying machine having an electrode confronting a photo-sensitive member, to which electrode a voltage is applied during development, a bias device which comprises:

memory means for storing the potential of the surface of said photo-sensitive member;

voltage generating means for providing a bias voltage obtained by superposing a predetermined potential on the potential stored in said memory means;

potential detecting switch means for allowing the potential of the surface of said photo-sensitive member to be stored in said memory means;

bias voltage applying switch means for selectively applying a positive bias voltage and a negative bias voltage to said electrode; and change-over switch means for switching said positive bias voltage or negative bias voltage to be applied to said bias voltage applying switch, and in which a non-image period occurs when said photo-sensitive member is divided into a negative bias period and an electrode potential detection period; in said negative bias period said bias voltage applying switch means is turned on while an armature of said change-over switch means is tripped to a negative bias contact thereof; in said electrode potential detection period said bias voltage applying switch means is turned off while said potential detecting switch means is turned on; and in the period of said development the armature of said change-over switch means is tripped over to a positive bias contact while said bias voltage applying switch means is turned on.

* * * * *